US011767484B1

(12) United States Patent
Gautam et al.

(10) Patent No.: US 11,767,484 B1
(45) Date of Patent: Sep. 26, 2023

(54) BIO-LUBRICANT WITH HIGH VISCOSITY AND METHOD

(71) Applicant: KING ABDULLAH UNIVERSITY OF SCIENCE AND TECHNOLOGY, Thuwal (SA)

(72) Inventors: Ribhu Gautam, Thuwal (SA); Tsu Fang Hong, Thuwal (SA); Subram Maniam Sarathy, Thuwal (SA)

(73) Assignee: KING ABDULLAH UNIVERSITY OF SCIENCE AND TECHNOLOGY, Thuwal (SA)

( * ) Notice: Subject to any disclaimer, the term of this patent is extended or adjusted under 35 U.S.C. 154(b) by 0 days.

(21) Appl. No.: 18/125,224

(22) Filed: Mar. 23, 2023

Related U.S. Application Data

(60) Provisional application No. 63/432,716, filed on Dec. 15, 2022, provisional application No. 63/323,137, filed on Mar. 24, 2022.

(51) Int. Cl.

| | |
|---|---|
| ***C11D 1/32*** | (2006.01) |
| ***C11D 3/18*** | (2006.01) |
| ***C11D 3/20*** | (2006.01) |
| ***C11D 3/382*** | (2006.01) |
| ***C11D 11/00*** | (2006.01) |
| ***C10M 111/02*** | (2006.01) |

(Continued)

(52) U.S. Cl.
CPC ..... *C10M 111/02* (2013.01); *C10M 159/12* (2013.01); *C10M 177/00* (2013.01); *C10M 2207/401* (2013.01); *C10N 2020/02* (2013.01); *C10N 2020/067* (2020.05); *C10N 2070/00* (2013.01)

(58) Field of Classification Search
CPC .... C11D 1/32; C11D 3/18; C11D 3/20; C11D 3/2093; C11D 3/382; C11D 11/00; C10M 111/02; C10M 159/12; C10M 177/00; C10M 2207/401
See application file for complete search history.

(56) References Cited

U.S. PATENT DOCUMENTS 8,809,026 B2 * 8/2014 Vanhercke ..... C11B 7/0075 435/468

FOREIGN PATENT DOCUMENTS

WO WO 2022/118198 * 6/2022 ..... B09B 3/60

OTHER PUBLICATIONS

Bullo, T.A., et al., "Biosynthesis of Sulfonated Carbon Catalyst from Carbohydrate Polymer Derivatives for Epoxidation of Croton Macrostachyus Seed Oil," Carbohydrate Polymer Technologies and Applications, Jun. 2022 (available online May 26, 2022), vol. 3, 100221, pp. 1-8, Elsevier.

(Continued)

*Primary Examiner* — Brian P Mruk
(74) *Attorney, Agent, or Firm* — PATENT PORTFOLIO BUILDERS PLLC

(57) ABSTRACT

A bio-lubricant composition includes a first component that includes a first triglyceride, which is part of a cooking oil; a second component that includes a first epoxidized triglyceride; a third component that includes a hydroxylated triglyceride; a fourth component that includes a first fatty acid ester moiety; a fifth component that includes a first epoxidized fatty acid ester; and a sixth component that includes a hydroxylated fatty acid ester. A mixture of the first to sixth components at room temperature have a viscosity between 40 and 200 centipoise, and the composition is substantially free of free fatty acids.

20 Claims, 15 Drawing Sheets

(51) Int. Cl.

| | |
|---|---|
| ***C10M 159/12*** | (2006.01) |
| ***C10M 177/00*** | (2006.01) |
| *C10N 70/00* | (2006.01) |
| *C10N 20/02* | (2006.01) |
| *C10N 20/00* | (2006.01) |

(56) References Cited

OTHER PUBLICATIONS

Musik, M., et al., "Advanced Methods for Hydroxylation of Vegetable Oils, Unsaturated Fatty Acids and Their Alkyl Esters," Coatings, 2022 (published Dec. 23, 2021), vol. 12, No. 13, pp. 1-18.
Rios, L., et al., "Hydroxylation of Vegetable Oils using Acidic Resins as Catalysts," Industrial Crops and Products, May 2013, vol. 43, pp. 183-187, Elsevier B.V.
Warabi, Y., et al., "Reactivity of Triglycerides and Fatty Acids of Rapeseed Oil in Supercritical Alcohols," Bioresource Technology, Feb. 2004, vol. 91, No. 3, pp. 283-287, Elsevier Ltd.
Borugadda, V.B., et al., "Hydroxylation and hexanoylation of epoxidized waste cooking oil and epoxidized waste cooking oil methyl esters: Process optimization and physico-chemical characterization," Industrial Crops & Products, vol. 133, 2019 (Available online Mar. 14, 2019), pp. 151-159.
Borugadda, V.B., et al., "Physicochemical and Rheological Characterization of Waste Cooking Oil Epoxide and Their Blends," Waste Biomass Valor, vol. 7, 2016 (Published online Sep. 23, 2015), pp. 23-30.
International Search Report and Written Opinion of the International Searching Authority (Forms PCT/ISA/220, PCT/ISA/210 and PCT/ISA/237), dated May 31, 2023, for corresponding/related International Application No. PCT/IB2023/052873.
Zhang, W., et al., "Green preparation of branched biolubricant by chemically modifying waste cooking oil with lipase and ionic liquid," Journal of Cleaner Production, vol. 274, Article 122918 Nov. 20, 2020, pp. 1-11.

* cited by examiner

| **Proximate Analysis** | **wt.%** | **Metal oxides** 1010 | **wt.%** |
|---|---|---|---|
| Moisture | 5 | Potassium oxide ($K_2O$) | 23.45 |
| Ash | 27 | Phosphorous pentoxide ($P_2O_5$) | 16.38 |
| Volatile Matter | 10 | Calcium oxide (CaO) | 26.36 |
| Fixed carbon | 58 | Sulfur trioxide ($SO_3$) | 8.86 |
| Gross calorific value (in MJ $kg^{-1}$) | | Magnesium oxide (MgO) | 7.66 |
| **Elemental Analysis** | **wt.%** | Silica ($SiO_2$) | 7.65 |
| C | 44 | Ferric oxide ($Fe_2O_3$) | 1.12 |
| H | 1 | Manganese oxide ($Mn_3O_4$) | 0.54 |
| N | 3 | Titanium dioxide ($TiO_2$) | 0.30 |
| S | 0.05 | Sodium oxide ($Na_2O$) | 4.51 |
| O | 14 | Aluminum oxide ($Al_2O_3$) | 1.55 |
| **BET Surface area** | **$m^2g^{-1}$** | | |
| Raw biochar | 13.63 | | |

FIG. 10

| Lubricants | Kinematic Viscosity ($m^2/s$) | | Viscosity Index | Pour Point (°C) |
|---|---|---|---|---|
| | At 40 °C | At 100 °C | | |
| Biolubricant base oil 450 | 16.1 | 4.8 | 252 | -13.97 |
| ISO VG32 | >28.8 | >4.1 | >90 | -6 |
| ISO VG46 | >41.4 | >4.1 | >90 | -6 |
| ISO VG68 | >61.4 | >4.1 | >198 | -6 |
| ISO VG100 | >90 | >4.1 | >216 | -6 |

FIG. 12

| Name of the sample | Thermal stability (°C) | | Oxidative stability (°C) | |
|---|---|---|---|---|
| | OT | PT | OOT | PT |
| UVCOs 410 | 165.5 | 161.1 | 159.3 | 179.1 |
| UVCO-derived FAMEs 414-426 | 176.3 | 226 | 180.7 | 190.0 |
| Hydroxylated FAMEs 450 | 265.9 | 327.3 | 246.8 | 268.4 |

FIG. 13

BIO-LUBRICANT WITH HIGH VISCOSITY AND METHOD

CROSS-REFERENCE TO RELATED APPLICATIONS

This application claims priority to U.S. Provisional Patent Application No. 63/323,137, filed on Mar. 24, 2022, entitled "BIOCHAR AS ADSORBENT AND CATALYST FOR CLEAN BIOLUBRICANT PRODUCTION," and U.S. Provisional Patent Application No. 63/432,716, filed on Dec. 15, 2022, entitled "BIO-LUBRICANT WITH HIGH VISCOSITY AND METHOD," the disclosures of which are incorporated herein by reference in their entirety.

BACKGROUND OF THE INVENTION

Technical Field

Embodiments of the subject matter disclosed herein generally relate to a composition and method for making the composition, where the composition is a bio-lubricant made from waste cooking oil using a biochar as a catalyst and adsorbent, and more particularly, to using an animal-based biochar for making an adsorbent and a catalyst to be used in a specific chemical process for transforming used cooking oil into a bio-lubricant with a high viscosity point.

Discussion of the Background

Lubricants perform as anti-friction media. They facilitate smooth operations, maintain reliable machine functions, and reduce the risks of frequent failures. At present, the high price of the crude oil, the restrictive distribution of the crude oil reserves in the world, and the shared concern in protecting the environment from pollution have renewed interest in developing and using environment-friendly lubricants derived from alternative sources, for example, a bio-lubricant obtained from waste cooking oil. A bio-lubricant is a renewable lubricant that is biodegradable, non-toxic, and does not add to the natural carbon cycle. Bio-lubricants are used today mainly as hydraulic fluids, lubricants for power tools (e.g., chainsaws), and potentially as motor lubricating fluids.

Bio-lubricants are biodegradable and non-toxic to humans and the environment, in particular to aquatic environments. For instance, vegetable oils have been applied for lubrication purposes for many years. They are known for their biodegradability, high lubricity, viscosity index, and flash point. Practices of using vegetable oils for lubricant applications is not completely new in the market. The technology to process bio-based feedstocks and to produce base oils for lubricants has been adopted by some key lubricant organizations for several years. These companies have added bio-based lubricants to their product portfolio.

However, bio-based lubricants also have several disadvantages. First, the discovery of petroleum and the availability of low-cost mineral oils make the utilization of bio-lubricants less competitive in the market. Second, bio-based lubricants are derived from renewable materials, frequently vegetable-based. These include rapeseed oil, sunflower oil, coconut oil, palm oil and soybean oil; these virgin renewable resources come with more disadvantages as (1) the virgin renewable resources are around 40-50% more expensive compared with conventional base oils, and (2) the virgin vegetable oil could potentially compete with the food value chain turning it into a rather unsustainable feedstock and product value chain.

Therefore, alternatives from waste feedstock are favoured in preparing bio-based lubricants, such as waste animal fats and used vegetable cooking oils (UVCOs). However, a problem with the process of manufacturing the bio-based lubricants is the cost and complications of separation encountered by the UVCOs esters currently used in these processes. Predominantly, the catalysts used to produce esters at industrial scales are homogeneous in phase with the oil. Further, the current catalysts are harmful to humans and the environment in general. Due to the above-mentioned problems (i.e., costs and complications of separation of catalysts from the product stream), their utilization has been discouraged lately. Other major disadvantages of homogeneous catalysts are recycling/recovery of the catalyst and generation of additional waste streams. These limitations were partly addressed by supercritical processes as no catalysts are used and high yields are achieved in short duration [1]. However, the costs associated with the installation and maintenance of such supercritical equipment capable of withstanding such high pressures make this process unattractive. In addition, traditional methods for producing biolubricants from UVCO do not meet the requirements for applications needing higher viscosity grades.

Thus, there is a need for a new process for generating bio-lubricants from waste cooking oil, that is not expensive, does not require sophisticated equipment, and the catalysts are also bio-based and not harmful to the environment.

SUMMARY OF THE INVENTION

According to an embodiment, there is a bio-lubricant composition that includes a first component that includes a first triglyceride, which is part of a waste cooking oil, a second component that includes a first epoxidized triglyceride, a third component that includes a hydroxylated triglyceride, a fourth component that includes a first fatty acid ester moiety, a fifth component that includes a first epoxidized fatty acid ester, and a sixth component that includes a hydroxylated fatty acid ester. A mixture of the first to sixth components at room temperature has a viscosity between 40 and 200 centipoise, and the composition is substantially free of free fatty acids.

According to another embodiment, there is a bio-lubricant composition that includes a first component that includes a first triglyceride, which is part of waste cooking oil, a second component that includes a first epoxidized triglyceride, which originates from a second triglyceride, which is part of the waste cooking oil, wherein the second triglyceride has been epoxidated to obtain the first epoxidized triglyceride, a third component that includes a hydroxylated triglyceride, which originates from a third triglyceride of the waste cooking oil, wherein the third triglyceride was epoxidized to form a second epoxidized triglyceride and the second epoxidized triglyceride was hydroxylated to form the hydroxylated triglyceride, a fourth component that includes a first fatty acid ester moiety, which originates from a first free fatty acid of the waste cooking oil, a fifth component that includes a first epoxidized fatty acid ester, which originates from a second free fatty acid of the waste cooking oil, and the second free fatty acid was esterified to form a second fatty acid ester moiety and the second fatty acid ester moiety was epoxidated to form the first epoxidized fatty acid ester, and a sixth component that includes a hydroxylated fatty acid ester, which originates from a third free fatty acid of the waste cooking oil, and the third free fatty acid was esterified to form a third fatty acid ester moiety, the third fatty acid ester moiety was epoxidated to form a second epoxidized fatty acid ester, and the second epoxidized fatty acid was hydroxylated to form the hydroxylated fatty acid ester. A mixture of the first to sixth components at room temperature has a viscosity between 40 and 200 centipoise, and the composition is substantially free of free fatty acids.

According to yet another embodiment, there is a method for making a bio-lubricant composition from waste cooking oil, and the method includes purifying the waste cooking oil with an activated biochar to obtain purified cooking oil, wherein the purified cooking oil includes triglycerides and free fatty acids, esterifying the purified cooking oil to transform substantially all the free fatty acids into fatty acid methyl ester moieties, wherein this step maintains a viscosity of the purified cooking oil when transformed into a first mixture of the triglycerides and the fatty acid methyl ester moieties, stabilizing a structure of the triglycerides and the fatty acid methyl ester moieties by epoxidation, which results in a second mixture of epoxidated triglycerides, epoxidated fatty acid esters, the triglycerides, and the fatty acid methyl ester moieties, and increasing the viscosity of the second mixture by opening epoxy rings with a hydroxylation process, which results in a third mixture of the triglycerides, the fatty acid methyl ester moieties, the epoxidated triglycerides, the epoxidated fatty acid esters, hydroxylated triglycerides, and hydroxylated fatty acid esters. The third mixture at room temperature has a viscosity between 40 and 200 centipoise.

BRIEF DESCRIPTION OF THE DRAWINGS

For a more complete understanding of the present invention, reference is now made to the following descriptions taken in conjunction with the accompanying drawings, in which:

FIG. 8A schematically illustrates the chemical structure of epoxidized triglycerides while

FIG. 10 indicates the chemical composition of the biochar used in the method of FIG. 3;

FIG. 12 compares the fluid flowing properties of a bio-lubricant composition derived based on the method of FIG. 3 with various standard oils in the industry;

FIG. 13 shows the effect of chemical modification on the thermal and oxidative stability of various cooking oils and their components.

DETAILED DESCRIPTION OF THE INVENTION

Figure 1:
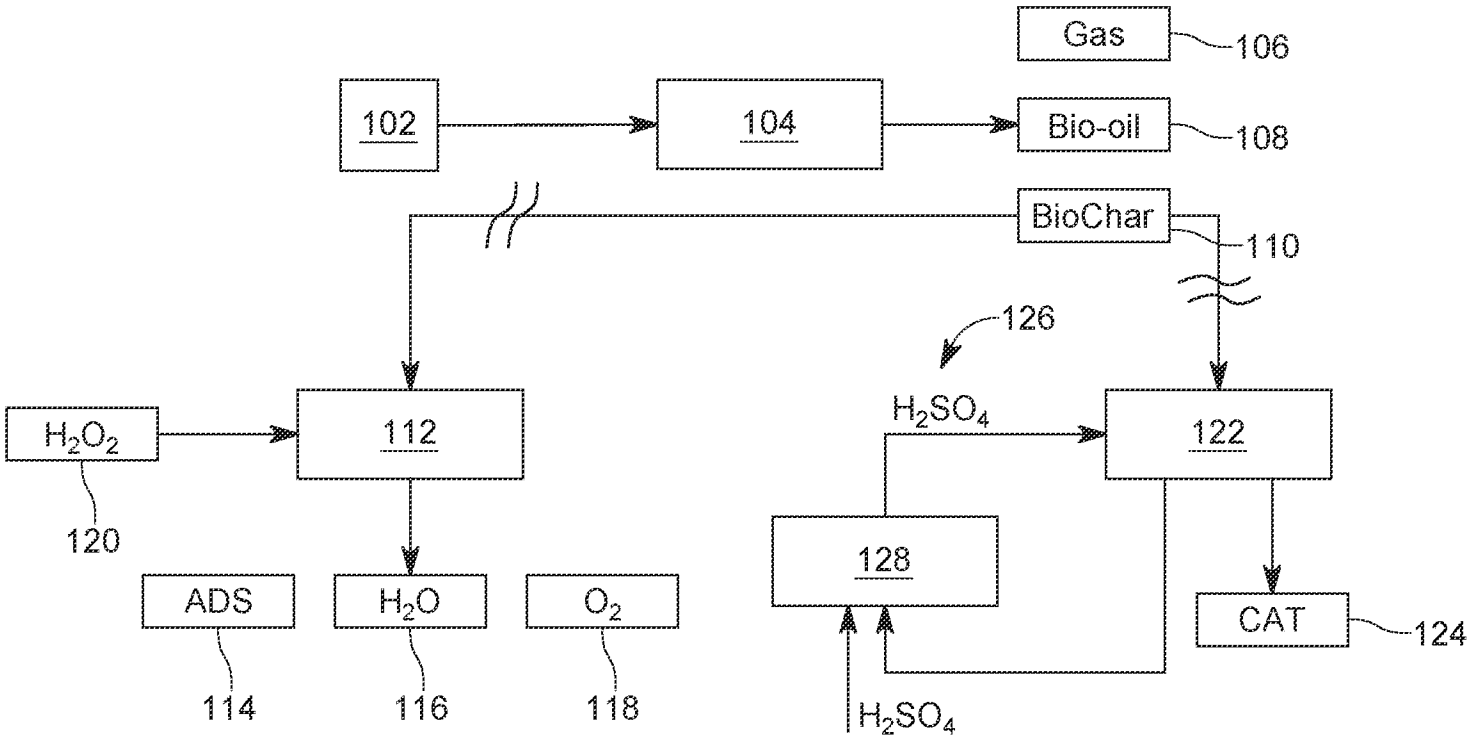
FIG. 1 is a schematic diagram of a method for transforming animal manure into a biochar and also for activating the biochar to become an adsorbent for a purification step and a catalyst for epoxidation and hydroxylation steps.

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to forming a bio-lubricant from waste cooking oil using an animal-based biochar as a catalyst and adsorbent. However, one skilled in the art would understand that the embodiments to be discussed next are not limited to waste cooking oil or animal-based biochar, but may be applied to other sources, and/or with other catalysts and/or absorbents.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

It will be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

According to an embodiment, a method for converting used vegetable cooking oil (UVCO) into bio-based lubricants using multifunctional biochar as adsorbent and catalyst is discussed. Biochars are promising materials produced from different thermochemical processes such as hydrothermal carbonization, hydrothermal liquefaction, gasification and pyrolysis. Biochars have been used for high-end applications such as catalyst support apart from toxic metal removal from wastewater, chemical and biodiesel production from biomass and soil amendment. The process of obtaining a biochar for the novel method of converting UVCOs into a biolubricant may be based on the process disclosed in International Patent Application PCT/IB2021/061146 (herein, "the '146 PCT application"), belonging to the assignee of the present application, the entire content of which is included herein by reference. The process disclosed in the '146 PCT application integrates biological processes and thermochemical conversion to give poultry waste a second life.

The use of the biochar obtained from poultry waste (note that a biochar obtained through other paths may also be used) not only establishes a greener process of treating the low-graded UVCOs, but also addresses one or more of the following problems: it replaces the conventional homogeneous catalysts (i.e., sulfuric acid) for the esterification process, as they are corrosive and difficult to recycle from the process, and/or applies renewable biochar adsorbents as produced from other waste streams (e.g., chicken manure, biomass).

The various aspects of the invention are now discussed with regard to the figures. First, the preparation of the biochar as adsorbent and catalyst is discussed followed by the process of treating the UVCOs to obtain the biolubricants. As illustrated in FIG. 1, chicken manure 102 is processed based on the process 104 described in the '146 PCT application, to generate a gas 106, a bio-oil 108, and a biochar 110. The biochar 110 is then used, in a first activation process 112 to form a biochar adsorbent 114. As a by-product, water 116 and oxygen 118 are also formed in this activation process. The activation process 112 uses hydrogen peroxide 120 for activating the biochar 110. For example, the treatment of 10 g of the raw biochar 110 with 2 g of hydrogen peroxide 120 results in the generation of 10 g of the adsorbent biochar 114, 1.1 g of the water 116, and 0.9 g of the oxygen 118.

Figure 2:
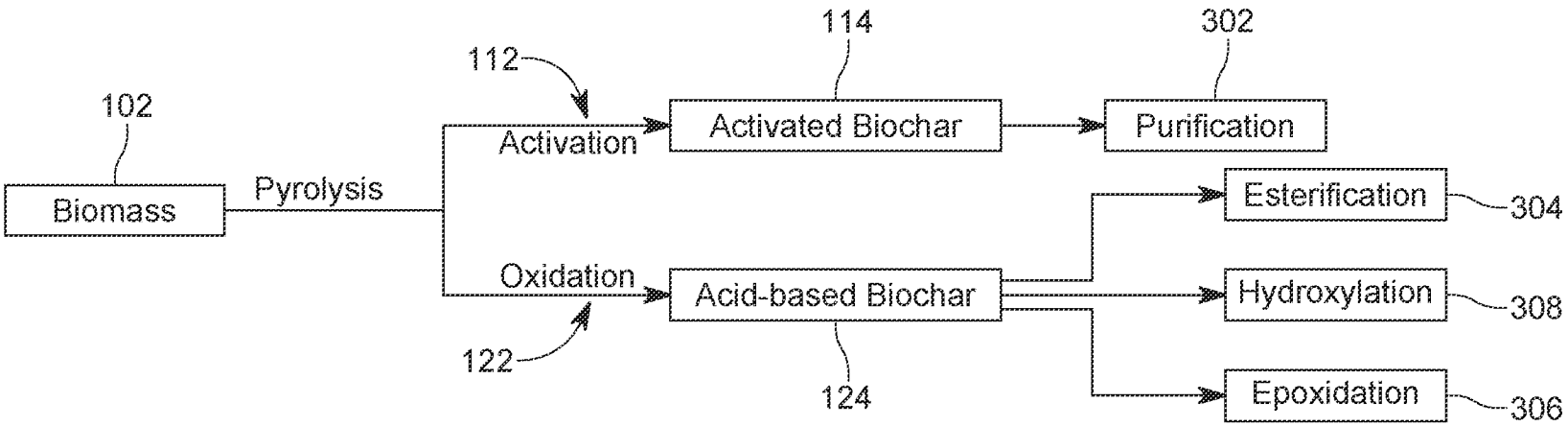
FIG. 2 is a schematic diagram indicating that an activated biochar is used in a purification step while an acid-based biochar is used in one or more of esterification, hydroxylation and epoxidation processes.

The same raw biochar 110 may be differently activated in step 122 to generate a biochar catalyst 124 by treating the biochar 110 with sulfuric acid 126. Part of the acid 126 is recovered in step 128 by known methods. For example, in step 122, each 10 g of the raw biochar 110 are treated with 4.5 g of acid 126 to generate the biochar catalyst 124. The two activation processes 112 and 122 discussed above are schematically illustrated in FIG. 2. This figure shows that the biomass 102 (for example, chicken manure) is transformed through pyrolysis followed by the activation process 112 to obtain the adsorbent activated biochar 114, which is used later for purifying 302 the waste cooking oil. The figure also shows that the biomass 102 is also transformed through pyrolysis followed by oxidation 122 with sulfuric acid to obtain the biochar catalyst 124, which is later used for esterification 304, epoxidation 306, and/or hydroxylation 308 of the UVCO.

Figure 3:
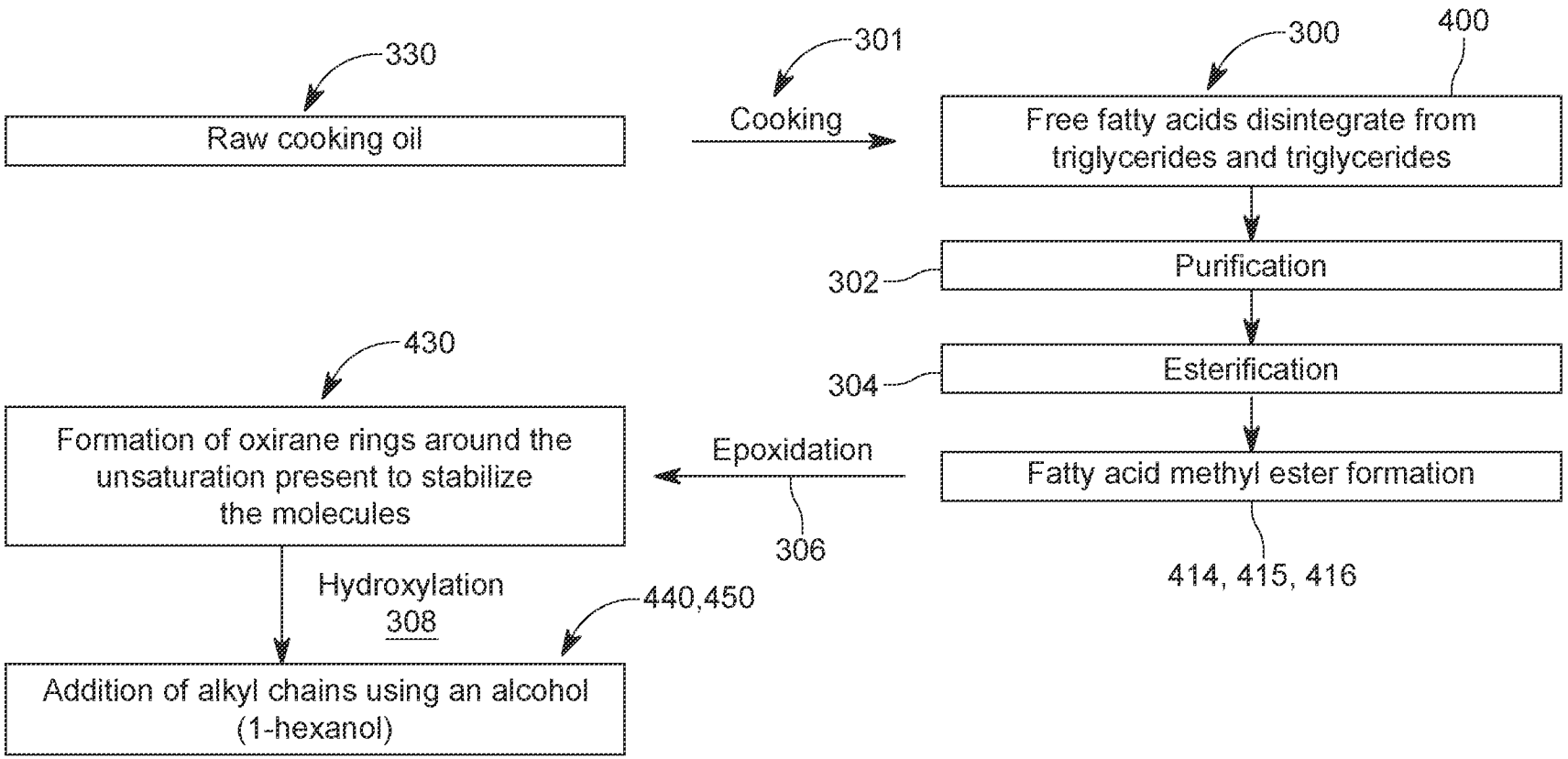
FIG. 3 is a flow chart of a method for making a bio-lubricant composition from a waste cooking oil based on animal manure biochars.
Figure 5:
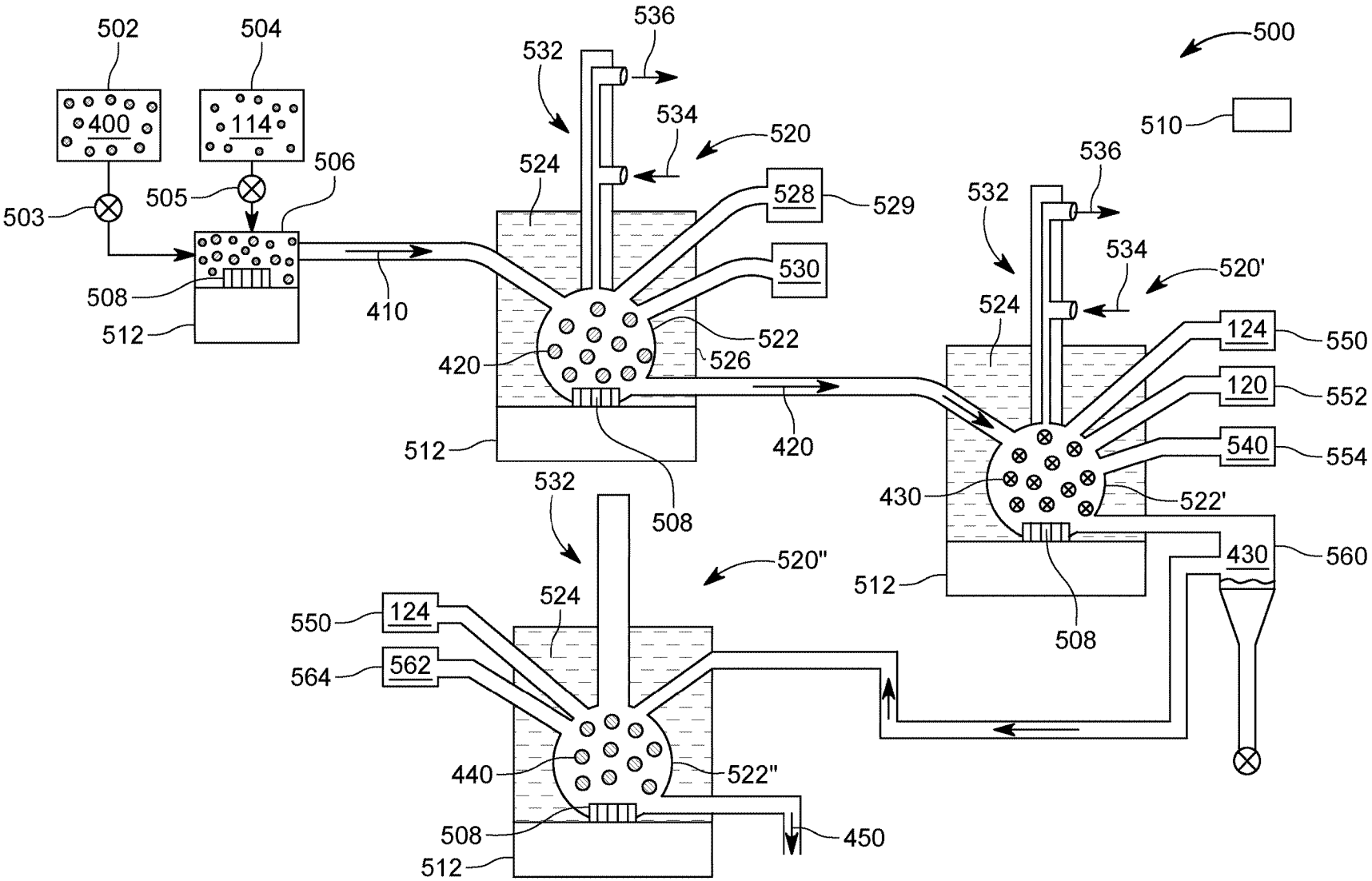
FIG. 5 schematically illustrates a reactor system that may be used for generating the bio-lubricant composition made with the method of FIG. 3.
Figure 6A:
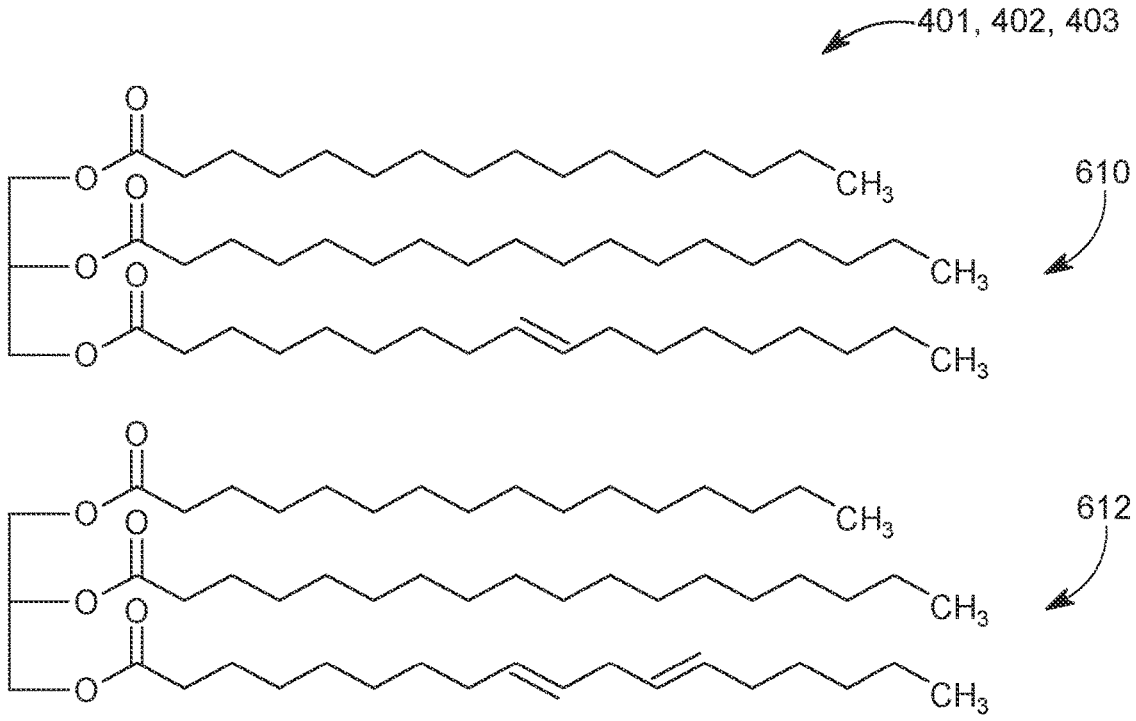
FIG. 6A schematically illustrates the chemical structure of the triglycerides of the waste cooking oil while FIG. 6B schematically illustrates the chemical structure of the free fatty acids of the waste cooking oil.
Figure 6B:
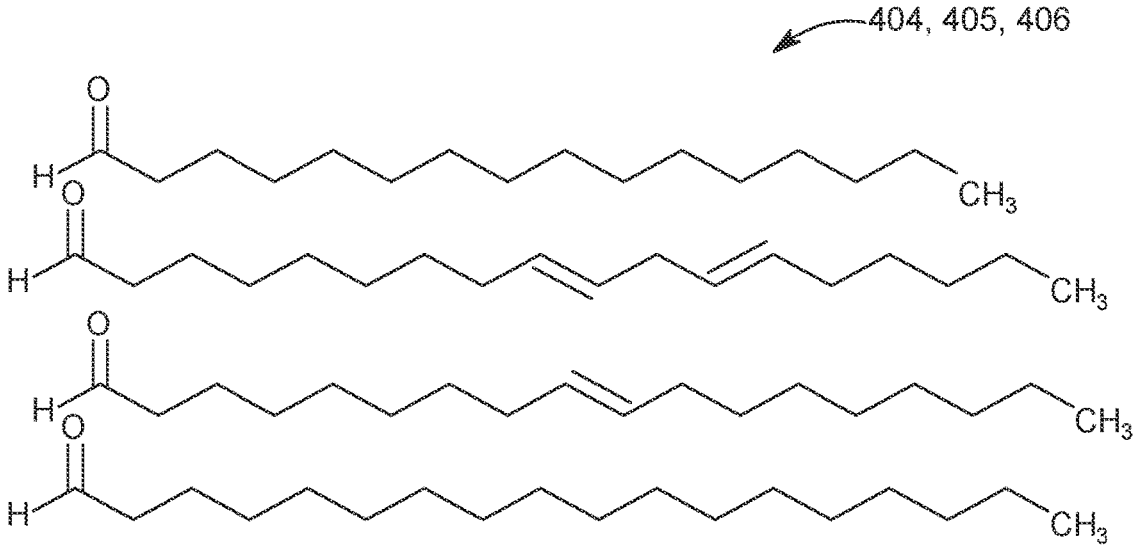

Next, a novel process for transforming the UVCO into a high viscosity bio-lubricant is discussed. FIG. 3 illustrates the method for making a bio-lubricant composition 450 (see FIG. 4) from waste cooking oil 400 (i.e., UVCO). FIG. 5 illustrates a possible reactor system 500 that may be used to generate the bio-lubricant composition 450. More specifically, the method includes a step 300 of receiving the waste cooking oil 400. It is noted that the waste cooking oil 400 is a result of a step 301 of cooking of raw cooking oil 330, a process that induces saturation of the molecules. The raw cooking oil 330 includes one or more types of triglycerides, which are esters derived from glycerol and fatty acids. The raw cooking oil may be any oil that is currently used for cooking (e.g., corn oil, canola oil, avocado oil, mustard oil, palm oil, peanut oil, rice bran oil, safflower oil, olive oil, sesame oil, sunflower oil, etc.) or any future oil that can be used for cooking The method further includes a step 302 of purifying the waste cooking oil 400 with the activated carbon 114 to obtain purified cooking oil 410, where the purified cooking oil 410 includes triglycerides 401 to 403 (two possible chemical structures are illustrated in FIG. 6A, but other chemical structures are also possible) and free fatty acids 404 to 406 (one possible chemical structure is illustrated in FIG. 6B, but other chemical structures are also possible). Note that the triglycerides 401 to 403 refer to members of a certain group of triglyceride molecules present in the purified cooking oil and not to the number of different types of triglyceride molecules. In other words, the waste cooking oil 400 may include triglyceride of a single type, or multiple types, but it needs to include at least three different molecule groups that would transform in various products as discussed later. In this regard, FIG. 6A shows two different types of molecules 610 and 612, but it is understood that there are at least 3 different groups (401 to 403) of molecules that will experience different chemical reactions during the process described in FIG. 3. The three different groups 401 to 403 may have the same type of molecules. In one application, each group may include different types of molecules.

FIG. 5 schematically illustrates a reactor installation 500 for transforming the waste cooking oil 400 into the biolubricant composition 450. The reactor installation 500 includes a first tank 502 that stores/receives the waste cooking oil 400. It also includes an adsorbent tank 504 that stores the adsorbent activated biochar 114. Corresponding valves 503 and 505 may be controlled by a global controller 510, for example, a computing device, to release a desired amount of the waste cooking oil 400 and the absorbent biochar 114 into a purification tank 506. A stirring element 508 (for example, a magnetic stirrer) may be placed in the purification tank 506 to mix the oil and the biochar. A heating element 512 is attached in this system, at the bottom of the purification tank, to heat the mixture to about 80° C. for about 2 h. The stirring element 508 may be configured from the controller 510 to rotate at about 600 rpm. In one application, each 1.5 kg of the oil 400 is mixed with about 75 g of the activated biochar 114. However, these amounts may be varied by plus or minus 15% and the term "about" is understood in this application to describe a deviation of +/−15% from the value of the reference value that the term refers to. The same definition is considered herein for the term "substantially."

An objective of the purification step 302 is to remove impurities obtained from different sources. The activated biochar 114 adsorbs small, polar organic molecules resulting from the high-temperature cooking and contact with various food resources. The adsorbent performance of the biochar 114 is controlled by the average pore diameters and pore volumes of the biochar and related molecular mechanisms. The purification potential of the activated biochar is attributed to the molecular diffusion and physic/chemisorption. The decomposed peroxide molecules and fatty acids of the waste cooking oil have molecule sizes ranging from 0.8 to 1.5 nm, which are much smaller than that of triglycerides (c.a. 5.8 nm). The small molecules adsorb on the biochar adsorbent 114 and are removed by subsequent precipitation and centrifugation processes (not shown). The total surface area and number of oxygenated functionalities are selected in the acid-based catalyst for the esterification of UVCOs. The oxygenated functionalities on the biochar serve as proton donors to catalyze the esterification of fatty acids with alcohol. The total surface area determines the catalytic efficiencies. The purification efficiency depends on the activated biochar applied.

In step 304, the purified cooking oil 410 is esterified to transform all the free fatty acids 404 to 406 into fatty acid methyl ester moieties 414, 415, and 416, where this step maintains a viscosity of a first mixture 420, which includes the triglycerides 401 to 403 and the fatty acid methyl ester moieties 414 to 416. Note that the first mixture 420 is obtained as a result of the esterification of the purified cooking oil 410. Also note that the term "all" used above to indicate that all the free fatty acids 404 to 406 have been esterified means that substantially all of them have undergo this transformation. One skilled in the art would understand that in chemistry, there is always the possibility that traces of the original substances or molecules have not been transformed, and a trace amount of them may be found in the final product. However, these trace elements of the unreacted compound are small and typically ignored when analyzing and reporting the composition of the reacted product. In one application, the amount of free fatty acids found in the first mixture 420 is smaller than 1% of the total mass of the first mixture, and thus, they are considered to be non-existent.

Figure 7:
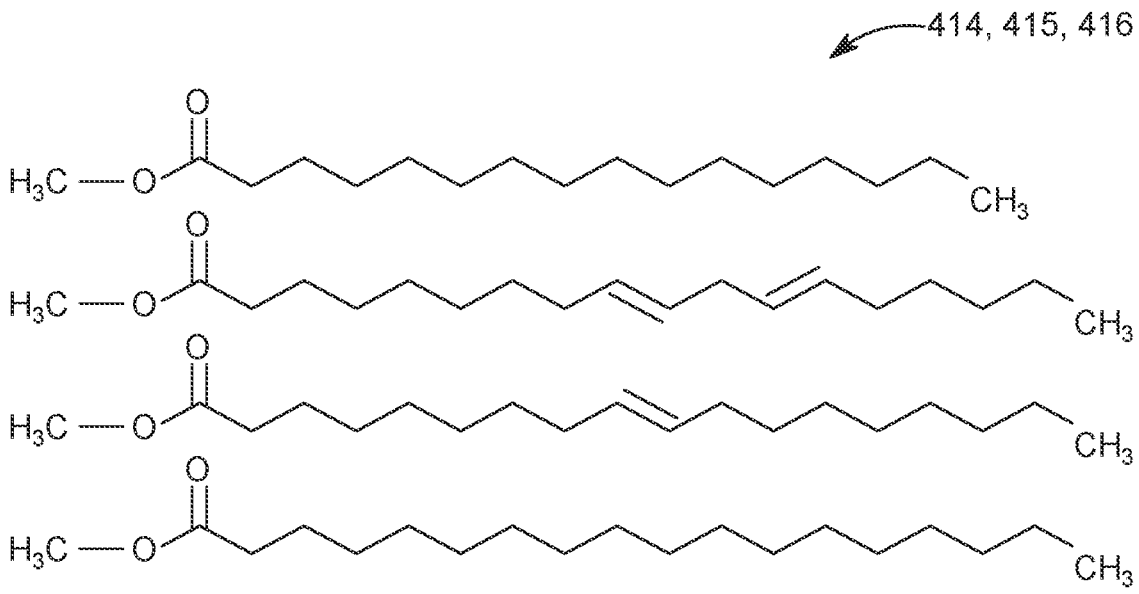
FIG. 7 schematically illustrates the chemical structure of fatty acid methyl ester moieties resulting from the esterification of the free fatty acids present in the waste cooking oil.

As a result of the esterification step 304, the free fatty acids have been transformed into fatty acids methyl esters 414 to 416, which are schematically illustrated in FIG. 7. Note that the methyl is present in these esters as the esterification step has used methanol. For example, in one application, this esterification step is performed in reaction unit 520, which is fluidly connected to an output of the purification tank 506. The purified cooking oil 410 is received in an inner container 522, which is placed in silicone oil 524. The silicone oil 524 is hold inside an outer container 526, which also holds the inner container 522, as schematically illustrated in FIG. 5. The inner container 522 may have a stirrer 508 and a heating element 512, similar to those previously discussed. The purified cooking oil 410, which includes the triglycerides 401 to 403 and the free fatty acids 404 to 406, is mixed in the inner container 522, with an alcohol (for example, methanol) 528 and sulfuric acid 530, which are stored in corresponding tanks 529 and 530, respectively. Thus, in this embodiment, the inner container 522 has three different inputs for receiving the above noted components. The inner container 522 further includes a reflux condenser 532 that has an inner tube that is cooled with chilled water that is pumped to inlet 534 and the water is extracted at outlet 536. In one application, for each 1 kg of the purified cooking oil 410, about 220 g of methanol and about 10 g of sulfuric acid are used, and the entire composition is heated to about 75° C. for about 8 h while the stirrer 508 is on, to generate the first mixture 420 (also see FIG. 4), which includes the triglycerides 401 to 403 and the fatty acid ester moieties 414 to 416. Note that no transesterification is performed in this step as the viscosity of the final product needs to be kept high.

The esterification step 304 is performed with a homogenous catalyst, i.e., the sulfuric acid. In one application, the purified cooking oil was first mixed with the methanol and then the sulfuric acid was slowly added to the mixture. The final product, which is a sweet smelling product, was transferred to a separation funnel (not shown). There were two phases observed in the separation funnel. The phase observed in the bottom was water, sulfuric acid and unreacted methanol. The esterified purified UVCO (i.e., the first mixture 420) was at the top and it was collected for subsequent reactions.

Figure 4:
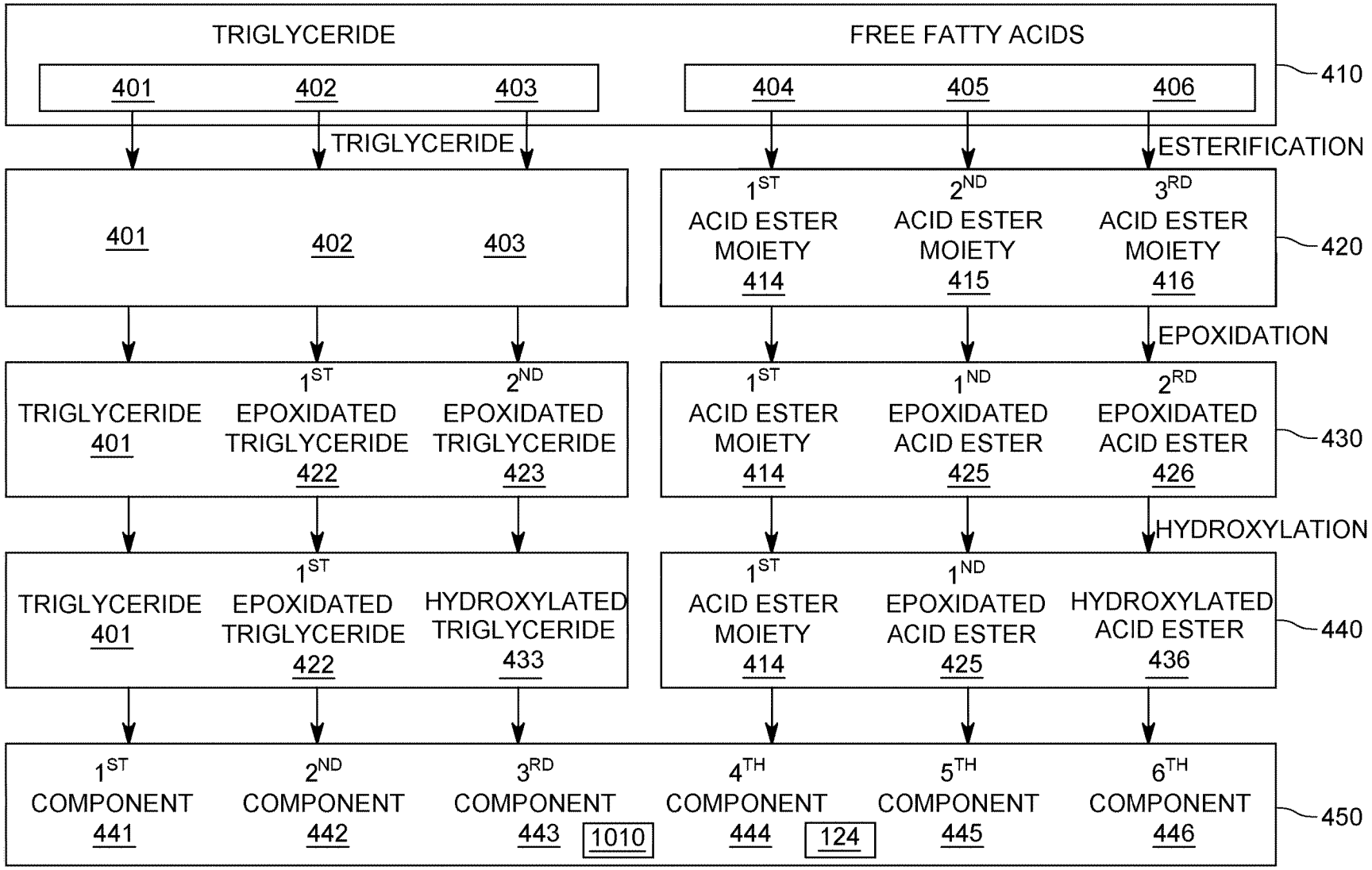
FIG. 4 schematically illustrates the starting triglycerides and free fatty acids in the waste cooking oil and how each step of esterification, epoxidation, and hydroxylation changes at least one group of these elements from a previous step.
Figure 8A:
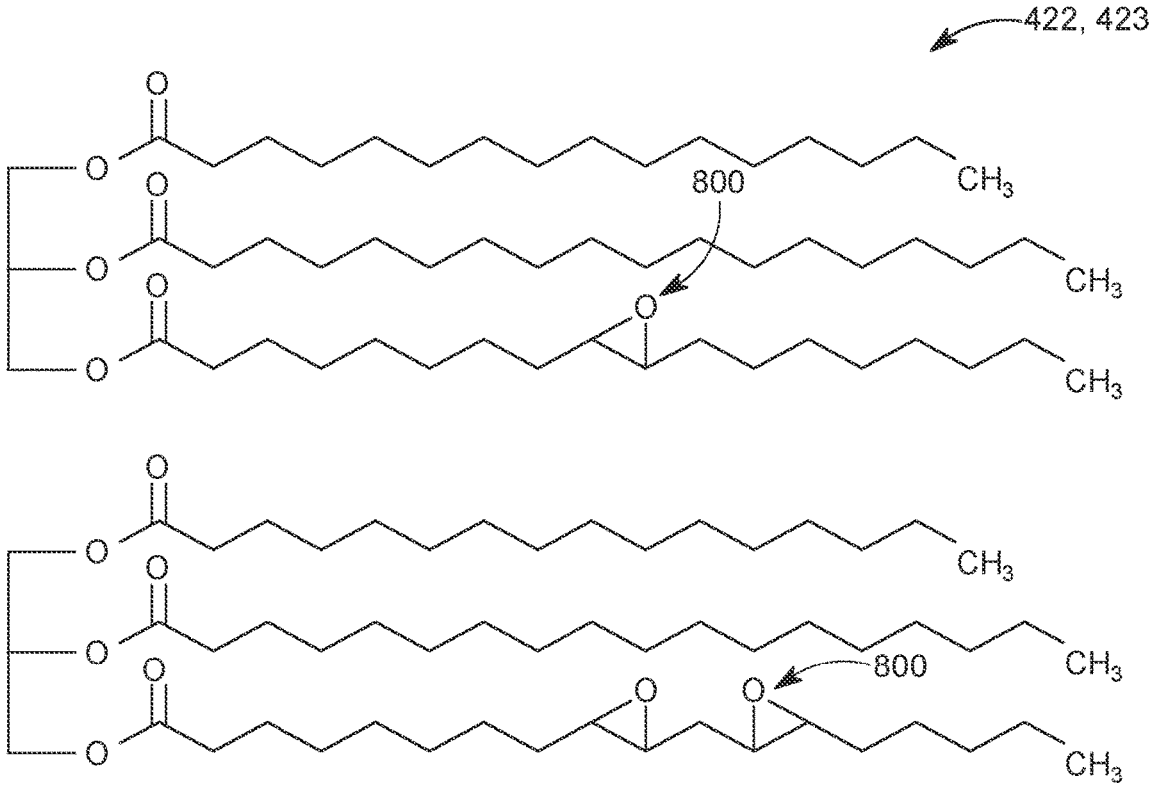
Figure 8B:
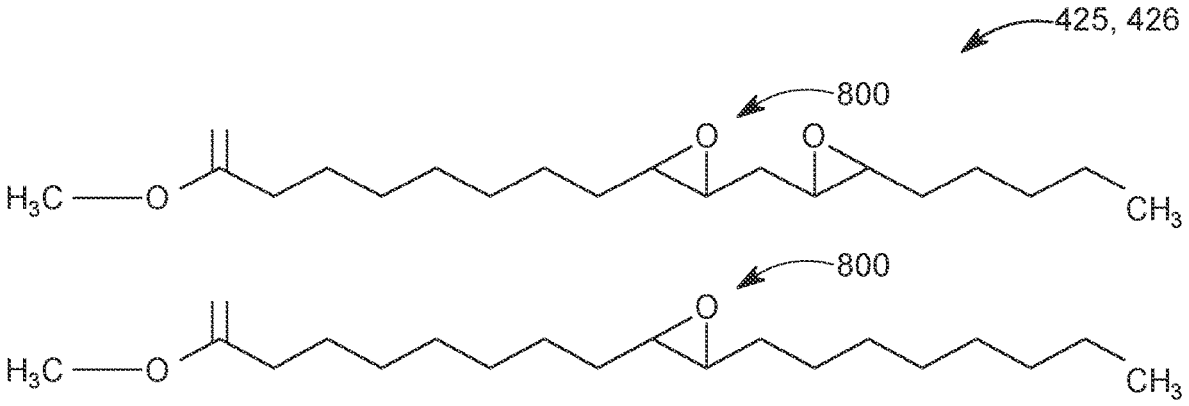
FIG. 8B illustrates the chemical structure of epoxidized fatty acids methyl esters.

In step 306, the structure of some of the triglycerides 401 to 403 and some of the fatty acid methyl ester moieties 414 to 416 is stabilized by epoxidation, which results in a second mixture 430, which includes epoxidated triglycerides 422 and 423, epoxidated fatty acid esters 425 and 426, the triglycerides 401, and the fatty acid methyl ester moieties 414, as schematically illustrated in FIG. 4. This step results in the formation of oxirane rings around the unsaturation of the existing molecules, as shown in FIGS. 8A and 8B. This step may take place in the reaction unit 520 or a similar reaction unit 520', after the first mixture 420 has been separated from other unwanted components.

The second reaction unit 520' receives the first mixture 420 from the first reaction unit 520, and also receives sulfonated carbon 124 (which acts as the heterogenous catalyst for the epoxidation reaction) from a first tank 550, hydrogen peroxide 120 from a second tank 552, and an acid 540 (for example, acetic acid) from a third tank 554. In one application, for each 1 kg of the first mixture 420, about 5% of the weight of the first mixture, which is about 50 g, of the sulfonated carbon, about 77% of the weight of the first mixture, which is about 774 g, of the sulfuric acid, and about 155 g of acetic acid are added to the inner tank 522' for the epoxidation reaction. The reaction takes place at about 60° C., for 6 h, while the stirrer 508 rotates at about 600 rpm. Note that the controller 510 is configured to add the hydrogen peroxide 120 in a dropwise manner. Further note that a heterogenous catalyst has been used in this step, which is derived from the activated biochar 124, thus replacing the use of a corrosive acid, like the sulfuric acid. To the contrary, the esterification step 304 used a homogenous catalyst, i.e., the sulfuric acid.

The chemical structures of the epoxidated triglycerides 422 and 423 are illustrated in FIG. 8A while the chemical structures of the epoxidated fatty acid esters 425 and 426 are illustrated in FIG. 8B. Note that these are some of the possible chemical structures, and other structures may be possible depending on the original content of the waste cooking oil 400. After running multiple experiments, the inventors have found that the sulfonated activated carbon 124 may be activated carbon/biochar, which is activated by sulfuric acid. Further, the inventors found that first the esterified first mixture 420 needs to be mixed up with the sulfonated activated carbon and the acetic acid and stirred at about 600 rpm. Then, the hydrogen peroxide is slowly added, dropwise, for 15 minutes into the mixture. This is done to prevent a rapid heat release as this is an exothermic reaction. This substep was performed at room temperature.

Finally, the temperature was increased to 60° C. for 6 h. After 6 h, the resulting product, i.e., the second mixture 430 was filtered (not shown). The residual activated carbon was separated for regeneration and then reuse. The filtered product (second mixture 430) was placed in a separation funnel 560, and two phases were observed in the separation funnel. The bottom fraction was water (a product from the epoxidation reaction) and acetic acid and the remaining fraction was the epoxidized purified UVCO, which was used in the next reaction in step 308.

Figure 9A:
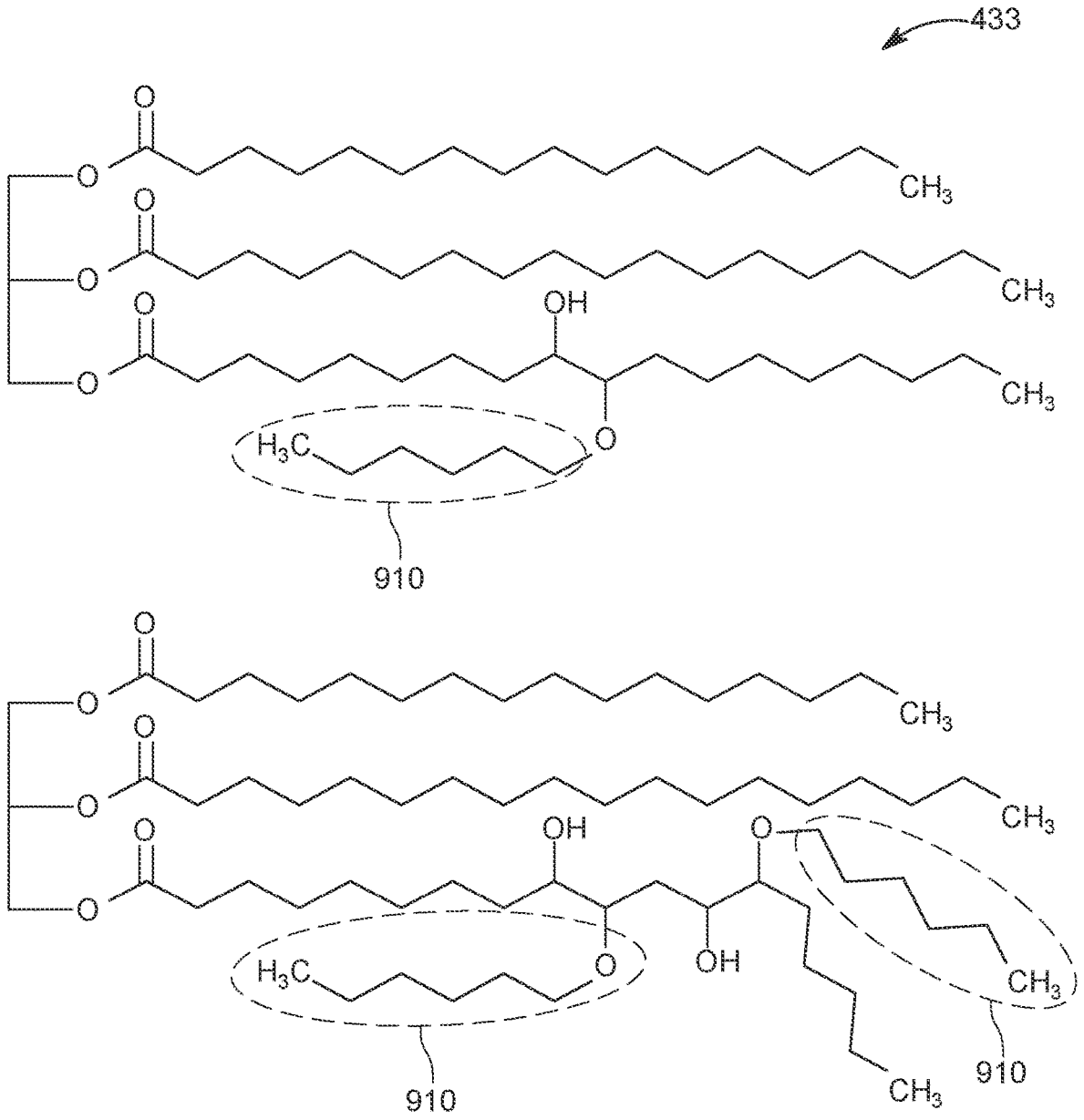
FIG. 9A schematically illustrates the chemical structure of hydroxylated triglycerides while FIG. 9B schematically illustrates the chemical structure of hydroxylated fatty acids methyl esters.
Figure 9B:
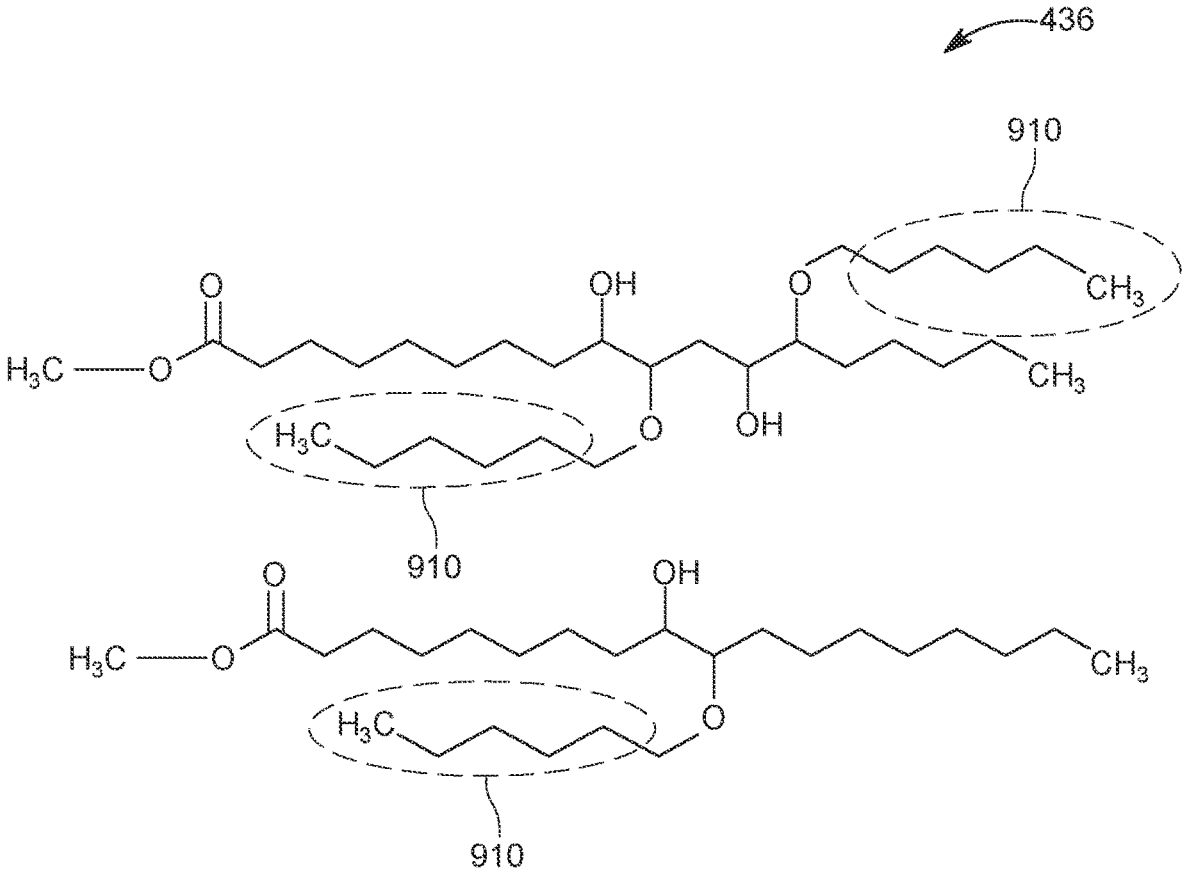

For increasing the viscosity of the resulting second mixture 430, the epoxy rings 800 (see FIGS. 8A and 8B) are opened in step 308 with a hydroxylation process. This step results in the formation of a third mixture 440, which includes the triglycerides 401, the fatty acid methyl ester moieties 414, the epoxidated triglycerides 422, the epoxidated fatty acid esters 425, hydroxylated triglycerides 433, and hydroxylated fatty acid esters 436. FIG. 4 schematically illustrates how each molecule originates from the initial purified cooking oil 410, FIG. 9A illustrates the molecule structure of the hydroxylated triglycerides 433, and FIG. 9B illustrates the molecule structure of the hydroxylated acid ester 436. Each molecule 401, 422, 433, 414, 425, and 436 in the third mixture 440 should be understood as belonging to a corresponding group of such molecules, i.e., there are six different groups of molecules (or components 441 to 446) at this stage in the process, which make up the final biolubricant composition 450.

The hydroxylation step is performed for branching in the final molecule and FIGS. 9A and 9B show the 1-hexanol provided branching 910 to the bio-lubricant 450. While the branching is provided in this specific example by the 1-hexanol, one skilled in the art would understand that other alcohols may be used, for example, 1-heptanol, 1-octanol, 1-nonanol, 1-decanol, 1-undecanol, or 1-dodecanol. The branch 910 of the hydroxylated triglycerides 433 and/or the hydroxylated fatty acid esters 436 of the third mixture 440 includes a carbon chain having between 6 and 12 carbon atoms.

In this step, an alcohol (e.g., 1-hexanol) 562 in the presence of activated carbon/biochar catalyst 124 was used to open the rings 800 present in the epoxidized UVCO mixture 430. In a hydroxylation reactor 520", which can be similar to the reactor 520 or 520', for each 1 kg of the second mixture 430 (i.e., the epoxidized purified UVCO), 20 g of activated carbon catalyst 124 was added and stirred at about 600 rpm. Then, for each 1 kg of the second mixture 430, about 182 g of 1-hexanol 562 was added and the stirring process was continued. The temperature inside the inner container 522" was raised to 80° C. and the mixture was kept at this temperature for 2 h. After 2 h, the third mixture 440 was generated and then it was filtered to remove the activated carbon. The filtered product is the final bio-lubricant base oil 450. Note that the alcohol 562 is stored in a corresponding tank 564.

At a minimum, according to this embodiment, the final composition 450 includes six different groups of molecules (or components) 441 to 446, where the first group or component 441 includes the first triglyceride 401, the second component 442 includes the first epoxidized triglyceride 422, the third component 443 includes the hydroxylated triglyceride 433, the fourth component 444 includes the first fatty acid ester moiety 414, the fifth component 445 includes the first epoxidized fatty acid ester 425, and the sixth component 446 includes the hydroxylated fatty acid ester 436. It was observed that a mixture of the first to sixth components at room temperature has a viscosity between 40 and 200 centipoise, and the composition 450 is substantially free of free fatty acids.

The first epoxidized triglyceride 422 originates from the second triglyceride 402, which is part of the cooking oil 400, and the second triglyceride 402 has been epoxidated to obtain the first epoxidized triglyceride 422. The hydroxylated triglyceride 433 originates from the third triglyceride 403 of the cooking oil 400, where the third triglyceride 403 was previously epoxidized to form the second epoxidized triglyceride 423 and the second epoxidized triglyceride 423 was hydroxylated to form the hydroxylated triglyceride 433.

The first fatty acid ester moiety 414 originates from the first free fatty acid 404 of the cooking oil 400 and was obtained from the esterification of the first free fatty acid 404. The first epoxidized fatty acid ester 425 originates from the second free fatty acid ester 405 of the cooking oil 400, and the second free fatty acid 405 has been esterified to form the second fatty acid ester moiety 415 and the second fatty acid ester moiety 415 has been epoxidated to form the first epoxidized fatty acid ester 425. The hydroxylated fatty acid ester 436 originates from the third free fatty acid 406 of the cooking oil 400, and the third free fatty acid 406 has been esterified to form the third fatty acid ester moiety 416, the third fatty acid ester moiety 416 has been epoxidated to form the second epoxidized fatty acid ester 426, and the second epoxidized fatty acid ester 426 has been hydroxylated to form the hydroxylated fatty acid ester 436.

The inventors have studied the chemical composition of the composition 450 and they found traces of the biochar 114/124 that is used as a catalyst and absorbent, where the biochar is feedstock based. In this regard, the carbon/biochar 110 was treated with sulfuric acid to produce the activated carbon 124 with sulfonyl sites. A mixture with sulfuric acid (98%) and water in the ratio of 80:20 (v/v) was prepared in one application. About 50 g of the activated carbon was mixed with 950 g sulfuric acid-water mixture. This mixture was heated to 80° C. and stirred at 600 rpm using a magnetic stirrer for 12 h. After 12 h, this activated carbon was then washed with distilled water (ambient conditions) and filtered (similar filtration procedure). The recovered activated carbon 124 with sulfonyl sites was dried in an oven at 120° C. for 8 h.

From the chemical analysis of the composition 450, the inventors found that the biochar activated as an adsorbent 114 (for the catalyst 124, additional products may be present) has the composition shown in the table of FIG. 10. Traces of the metal oxides 1010 listed in this table have been found in the composition 450. Thus, the novel composition 450 obtained with the method illustrated in FIG. 3 above has a specific fingerprint due to the adsorbent and catalyst used, and this fingerprint includes at least potassium oxide, phosphorous pentoxide, calcium oxide, and sulfur trioxide. In one application, the fingerprint further includes: magnesium oxide; silica; ferric oxide; manganese oxide; titanium dioxide; zinc oxide; and copper oxide and all these elements are also found in the composition 450.

Figure 11:
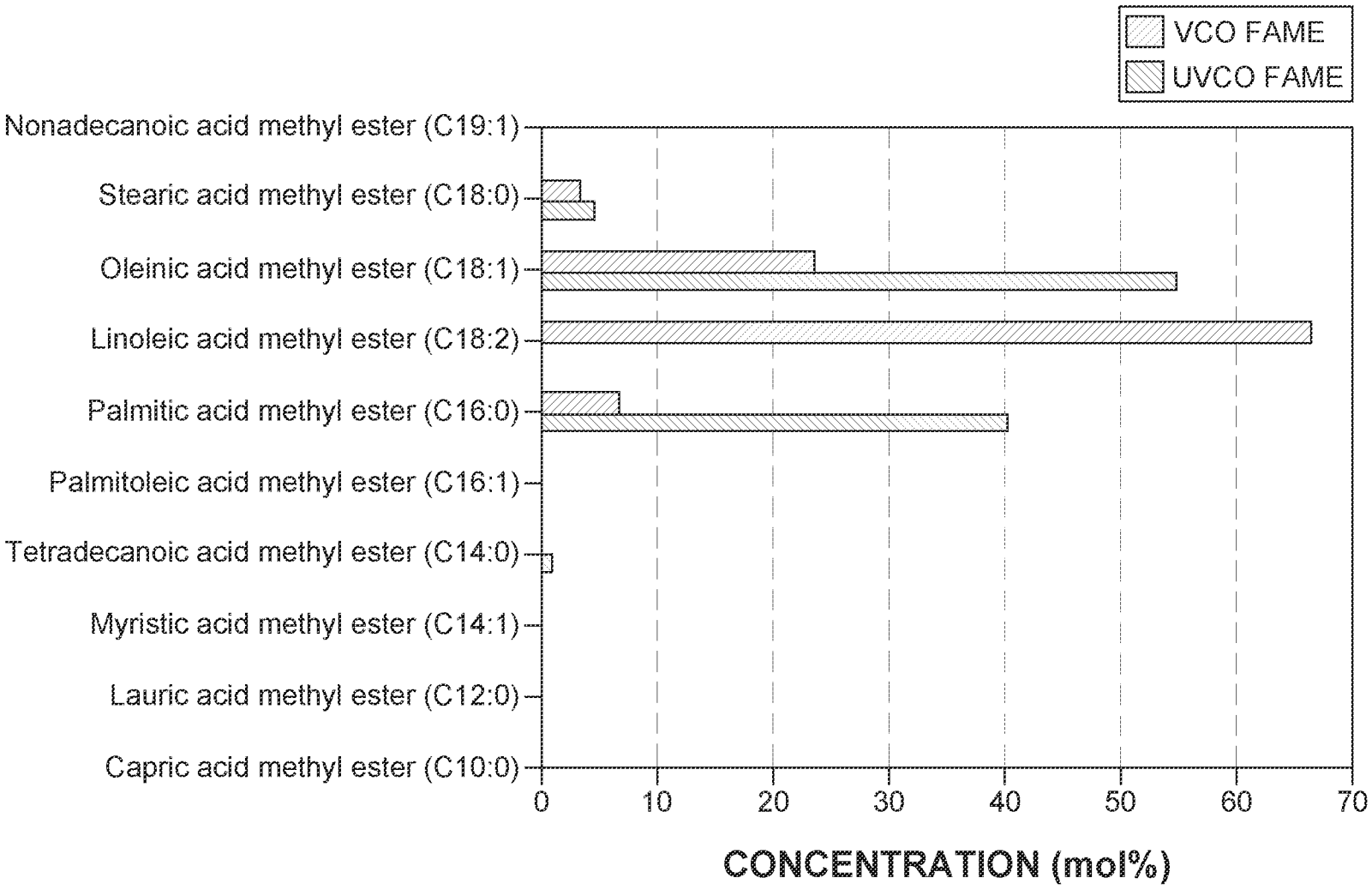
FIG. 11 illustrates the chemical composition of the vegetable cooking oil and waste cooking oil used in the method of FIG. 3.

The type of UVCO-derived fatty acid methyl esters (FAMEs) and those derived from vegetable cooking oil (VCO) are illustrated in FIG. 11. The unsaturation degree of VCO was attributed to oleic acid and linoleic acid. The high temperature cooking catalysed by water decomposes the double bond of linoleic acid into oleic acid or palmitic acid. Therefore, the UVCOs 410 may mostly contain only one double bond, which contributes to lower thermal and oxidative stability. The epoxidation and hydroxylation processes illustrated in FIG. 3 are introduced to enhance the thermal and oxidative stability of the bio-derived bio-lubricant composition 450.

The branching imparted to the third mixture 440 in step 308 controls the viscosity of the final composition 450. The inventors have measured the viscosity of the synthesized bio-lubricant base oil 450 and when compared to the International Standard Organization (ISO) graded lubricant oils, the results are as presented in the table of FIG. 12. It is noted that the synthesized bio-based lubricant 450 has the highest viscosity index. This indicates that the fluid flowing properties of the bio-based bio-lubricants are more resistant to the temperature changes when applying it in engines. In terms of the thermal and oxidative stability of the UVCOs, UVCO-derived FAMEs, and the hydroxylated composition 450, the inventors found, as illustrated in the table of FIG. 13, that the chemical modification via esterification, epoxidation and hydroxylation improves the thermal and oxidative stabilities by breaking triglycerides into small FAMEs and further reducing unsaturation degrees. The hydroxylated FAMEs, as compared to FAMEs, have better thermal and oxidative stability because the double bonds on alkyl chains are replaced by hydroxyl group and alkyl esters.

Figure 14:
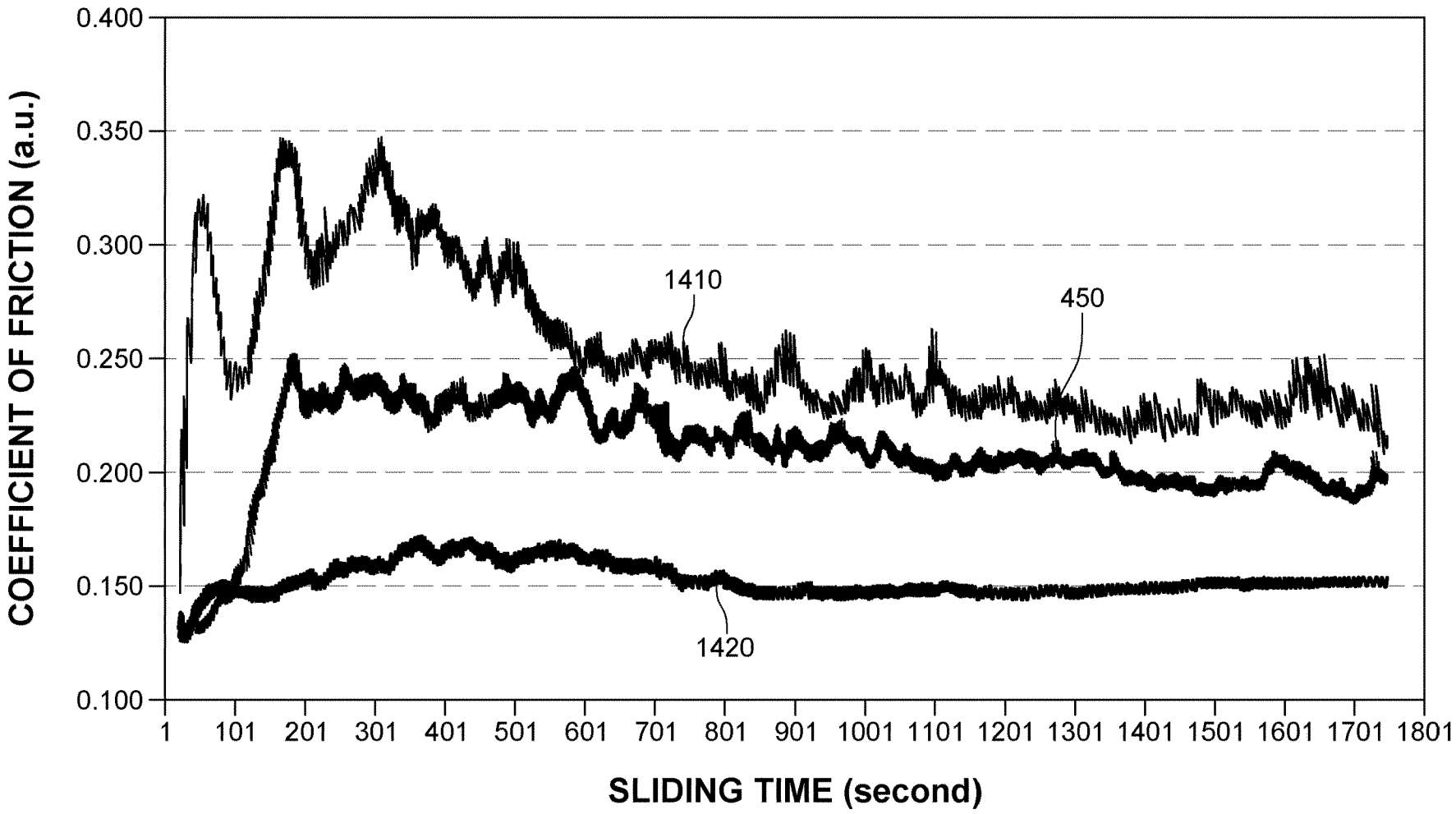
FIG. 14 indicates the boundary lubrication performances of the bio-lubricant composition of FIG. 3 and other oils.

FIG. 14 illustrates the boundary lubrication performances of a Group II base oil 1410, UVCO bio-lubricant 450, and UVCO bio-lubricant blended with state-of-the-art multifunctional polyether block copolymer 1420. The coefficient of friction for each of these oils was measured under a force of 50 N, sliding speed 0.1 m/s, and controlled temperature at 50° C. for 30 minutes. The average coefficient of friction measured in the UVCO bio-lubricant 450 was approximately 20% lower than that of group II base oil 1410, owing to the molecular structure of synthesized hydroxylated FAMEs. The hydroxyl group enhances the interaction with metallic surfaces, forming a layer of protective oil films that separate direct metallic contacts. The addition of multifunctional polyether further reduces the friction by 25%. A strong layer of tribofilms was produced by the blended multifunctional polyether, which is resistive to the high-load-and-high-frequency mechanical rubbing process.

Ball wear scars were generated for different oil lubrications (not shown). The ball wear scars resulted from frequent metal-to-metal contacts and subsequent adhesive forces that remove contacting surface material. Lubrication with UVCO bio-lubricant 450 reduced the ball wear scar size by approximately 20% as compared to Group II base oil 1410. The carbonyl and hydroxyl groups present in the UVCO-derived bio-lubricant 450 enhanced the molecular interaction with the metallic surfaces, forming protective oil films that reduce surface material wear. The addition of multifunctional polyether to the UVCO bio-lubricant could synergize with UVCO bio-lubricant and further reduced ball wear scar by 25%.

One of the advantages of the UVCO bio-lubricant 450 over the synthetic lubricants listed in FIG. 12 is its biodegradability character. The biodegradability of the prepared bio-lubricant base oil 450 has been determined using a bio-kinetic model as per American Society for Testing and Materials (ASTM) D 7373-12. The cumulative biodegradation values and biodegradability of the UVCO 400 and UVCO derived bio-lubricant base oil 450 was found to be 1.06; 93.6% and 1.04; 90.8% respectively. This is because the peroxides of the UVCOs 410, which initiate the auto oxidation, are removed by the chemical modification processes, including esterification, epoxidation, and hydroxylation.

Other advantages that may be achieved with the composition 450 discussed above includes: reusing the biochar produced from chicken manure, reducing the corrosive acid use in bio-lubricant productions, recycling the biochar adsorbent and catalysts from bio-lubricant productions, removing hazardous contaminates and chemicals from the process, reducing the amount of energy lost to friction in moving parts by providing a superior biolubrication, removing the use of fossil derived lubricants, reusing waste and used cooking oil that would be destined for disposal or combustion, and removing carbon emissions by creating durable carbon in the form of long lifetime bio-lubricants. The process discussed above with regard to FIG. 3 reduces $CO_2$ emissions by valorising multiple waste resources including used vegetable cooking oil, and deriving the biochar-based adsorbent and catalysts from chicken waste manure.

The disclosed embodiments provide a method for making a bio-lubricant with enhanced properties and a bio-lubricant composition with a viscosity between 40 and 200 centipoise, based on waste cooking oil. It should be understood that this description is not intended to limit the invention. On the contrary, the embodiments are intended to cover alternatives, modifications and equivalents, which are included in the spirit and scope of the invention as defined by the appended claims. Further, in the detailed description of the embodiments, numerous specific details are set forth in order to provide a comprehensive understanding of the claimed invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

REFERENCES

The entire content of all the publications listed herein is incorporated by reference in this patent application.

[1] Warabi Y, Kusdiana D, Saka S. Reactivity of triglycerides and fatty acids of rapeseed oil in supercritical alcohols. *Bioresour Technol* 91:283-287 (2004).

What is claimed is:

1. A bio-lubricant composition comprising:

a first component that includes a first triglyceride, which is part of a waste cooking oil;

a second component that includes a first epoxidized triglyceride;

a third component that includes a hydroxylated triglyceride;

a fourth component that includes a first fatty acid ester moiety;

a fifth component that includes a first epoxidized fatty acid ester; and a sixth component that includes a hydroxylated fatty acid ester, wherein a mixture of the first to sixth components at room temperature has a viscosity between 40 and 200 centipoise, and wherein the composition is substantially free of free fatty acids.

2. The composition of claim 1, wherein the first epoxidized triglyceride originates from a second triglyceride, which is part of the waste cooking oil, and wherein the second triglyceride has been epoxidated to obtain the first epoxidized triglyceride.

3. The composition of claim 1, wherein the hydroxylated triglyceride originates from a third triglyceride of the waste cooking oil, wherein the third triglyceride was previously epoxidized to form a second epoxidized triglyceride and the second epoxidized triglyceride was hydroxylated to form the hydroxylated triglyceride.

4. The composition of claim 1, wherein the first fatty acid ester moiety originates from a first free fatty acid of the waste cooking oil and the first fatty acid ester moiety is obtained from the esterification of the first free fatty acid.

5. The composition of claim 1, wherein the first epoxidized fatty acid ester originates from a second free fatty acid ester of the waste cooking oil, the second free fatty acid has been esterified to form a second fatty acid ester moiety, and the second fatty acid ester moiety has been epoxidated to form the first epoxidized fatty acid ester.

6. The composition of claim 1, wherein the hydroxylated fatty acid originates from a third free fatty acid of the waste cooking oil, the third free fatty acid has been esterified to form a third fatty acid ester moiety, the third fatty acid ester moiety has been epoxidated to form a second epoxidized fatty acid ester, and the second epoxidized fatty acid ester has been hydroxylated to form the hydroxylated fatty acid.

7. The composition of claim 1, further comprising:

traces of a biochar that is used as a catalyst and absorbent, wherein the biochar is feedstock based.

8. The composition of claim 1, further comprising:

traces of a biochar that is used as a catalyst and absorbent, wherein the traces of the biochar include at least potassium oxide, phosphorous pentoxide, calcium oxide, and sulfur trioxide.

9. The composition of claim 8, wherein the traces of the biochar further include:

magnesium oxide;

silica;

ferric oxide;

manganese oxide;

titanium dioxide;

zinc oxide; and copper oxide.

10. A bio-lubricant composition comprising:

a first component that includes a first triglyceride, which is part of waste cooking oil;

a second component that includes a first epoxidized triglyceride, which originates from a second triglyceride, which is part of the waste cooking oil, wherein the second triglyceride has been epoxidated to obtain the first epoxidized triglyceride;

a third component that includes a hydroxylated triglyceride, which originates from a third triglyceride of the waste cooking oil, wherein the third triglyceride was epoxidized to form a second epoxidized triglyceride and the second epoxidized triglyceride was hydroxylated to form the hydroxylated triglyceride;

a fourth component that includes a first fatty acid ester moiety, which originates from a first free fatty acid of the waste cooking oil;

a fifth component that includes a first epoxidized fatty acid ester, which originates from a second free fatty acid of the waste cooking oil, and the second free fatty acid was esterified to form a second fatty acid ester moiety and the second fatty acid ester moiety was epoxidated to form the first epoxidized fatty acid ester; and a sixth component that includes a hydroxylated fatty acid ester, which originates from a third free fatty acid of the waste cooking oil, and the third free fatty acid was esterified to form a third fatty acid ester moiety, the third fatty acid ester moiety was epoxidated to form a second epoxidized fatty acid ester, and the second epoxidized fatty acid was hydroxylated to form the hydroxylated fatty acid ester, wherein a mixture of the first to sixth components at room temperature has a viscosity between 40 and 200 centipoise, and wherein the composition is substantially free of free fatty acids.

11. A method for making a bio-lubricant composition from waste cooking oil, the method comprising:

purifying the waste cooking oil with an activated biochar to obtain purified cooking oil, wherein the purified cooking oil includes triglycerides and free fatty acids;

esterifying the purified cooking oil to transform substantially all the free fatty acids into fatty acid methyl ester moieties, wherein this step maintains a viscosity of the purified cooking oil when transformed into a first mixture of the triglycerides and the fatty acid methyl ester moieties;

stabilizing a structure of the triglycerides and the fatty acid methyl ester moieties by epoxidation, which results in a second mixture of epoxidated triglycerides, epoxidated fatty acid esters, the triglycerides, and the fatty acid methyl ester moieties; and increasing the viscosity of the second mixture by opening epoxy rings with a hydroxylation process, which results in a third mixture of the triglycerides, the fatty acid methyl ester moieties, the epoxidated triglycerides, the epoxidated fatty acid esters, hydroxylated triglycerides, and hydroxylated fatty acid esters, wherein the third mixture at room temperature has a viscosity between 40 and 200 centipoise.

12. The method of claim 11, wherein the step of esterifying includes mixing the purified cooking oil with methanol in the presence of sulfuric acid.

13. The method of claim 11, wherein the step of stabilizing includes adding about 5% of sulfonated biochar to the triglycerides and the fatty acid methyl ester moieties.

14. The method of claim 13, further comprising:

adding about 77% acetic acid in the step of stabilizing the triglycerides and the fatty acid methyl ester moieties.

15. The method of claim 14, further comprising:

gradually adding hydrogen peroxide to the triglycerides and the fatty acid methyl ester moieties during the stabilizing step.

16. The method of claim 11, wherein the hydroxylation process includes:

adding an alcohol; and adding an activated biochar as a catalyst.

17. The method of claim 16, wherein the alcohol is one of 1-hexanol, 1-heptanol, 1-octanol, or 1-nonanol.

18. The method of claim 16, wherein the alcohol is 1-decanol or 1-undecanol.

19. The method of claim 16, wherein the alcohol is 1-dodecanol.

20. The method of claim 11, wherein a branch of the hydroxylated triglycerides and hydroxylated fatty acid esters of the third mixture includes a carbon chain having between 6 and 12 carbon atoms.

* * * * *